United States Patent [19]

Cross

[11] 4,146,980

[45] Apr. 3, 1979

[54] FOOTWEAR

[76] Inventor: Evelyn Cross, 53 First St., Linden, Johannesburg, South Africa, 2195

[21] Appl. No.: 804,362

[22] Filed: Jun. 7, 1977

[30] Foreign Application Priority Data

Jun. 10, 1976 [ZA] South Africa ..... 76/3451

[51] Int. Cl.[2] ..... A43B 21/34

[52] U.S. Cl. ..... 36/39

[58] Field of Search ..... 36/39

[56] References Cited

U.S. PATENT DOCUMENTS

| | | | |
|---|---|---|---|
| 759,665 | 5/1904 | Buff | 36/39 |
| 2,776,502 | 1/1957 | Taylor | 36/39 |
| 3,237,321 | 3/1966 | McKinley | 36/39 |
| 3,477,150 | 11/1969 | Shepherd | 36/39 |

FOREIGN PATENT DOCUMENTS

| | | | |
|---|---|---|---|
| 380973 | 12/1907 | France | 36/39 |

*Primary Examiner*—James Kee Chi

*Attorney, Agent, or Firm*—Young & Thompson

[57] ABSTRACT

An article of footwear including a heel, at least a portion of the heel which presents a rear ground engaging zone of the heel, being rotatable relative to the remainder of the article of footwear. Preferably, the heel comprises a base portion adapted to be attached to the remainder of the article of footwear; and a rotary portion rotatably mountable on the base portion and presenting a rear ground engaging edge of the heel.

1 Claim, 4 Drawing Figures

FOOTWEAR

This invention relates to footwear.

It is well known that the rear ground engaging edge of the heel of a shoe or boot is inclined to wear more rapidly than the remainder of the heel. Such wear is aggravated through frictional engagement with the ground where the wearer walks with a turning or swinging motion of his feet.

It is an object of the present invention to avoid or at least to minimize this disadvantage.

According to the invention an article of footwear includes a heel, at least a portion of the heel which presents a rear ground engaging zone of the heel being rotatable relative to the remainder of the article of footwear.

The entire heel may be rotatable relative to the remainder of the article of footwear.

Preferably, the heel comprises a base portion adapted to be attached to the remainder of the article of footwear; and a rotary portion rotatably mountable on the base portion and presenting a rear ground engaging edge of the heel.

The base portion may include a recess in which the rotary portion is locatable; and means adapted rotatably to mount the rotary portion in the recess.

The rotary portion may be of circular configuration and the recess in the base portion may be of complementary configuration.

The base portion may include a mounting spigot which extends into the recess and is adapted rotatably to mount an annular rotary portion.

The rotary portion may be removably mountable on the base portion.

For a clear understanding of the invention preferred embodiments will now be described by way of example with reference to the accompanying drawings in which.

Figure 1:
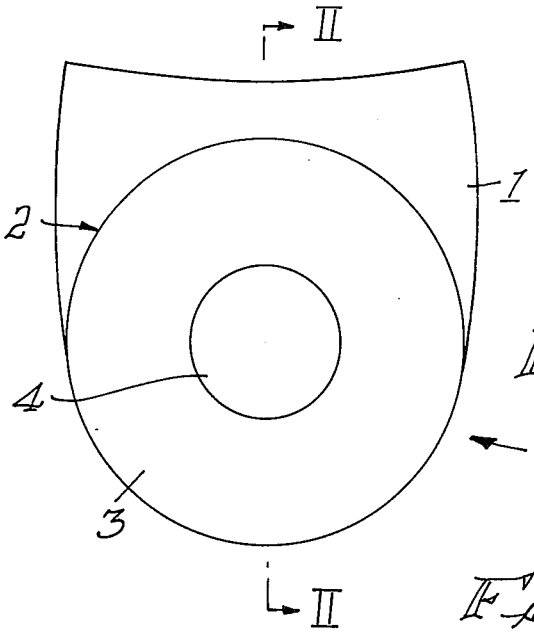
FIG. 1 is an inverted plan view of a heel according to the invention.
Figure 2:
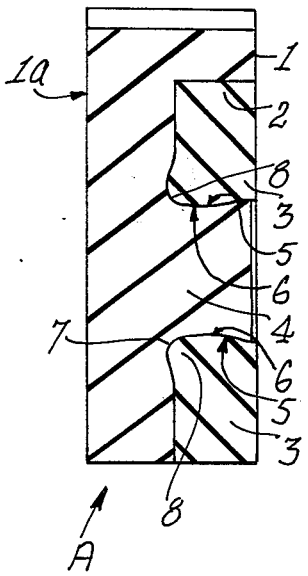
FIG. 2 is a section on the line II—II in FIG. 1.
Figure 3:
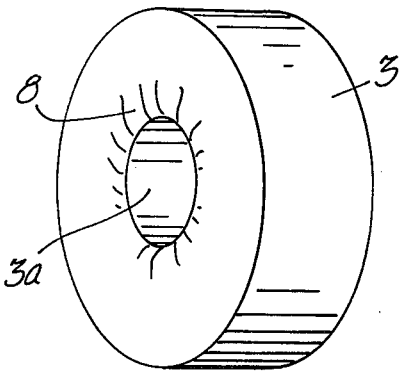
FIG. 3 is a perspective view of the annular rotary portion of the heel of FIGS. 1 and 2.

Referring first to FIGS. 1 to 3, the heel A comprises base portion 1 which is adapted to be attached to a shoe or boot in any suitable manner, such as by means of adhesive and/or nails and/or heat fusion, with the face la of base portion 1 abutting the shoe or boot. Base portion 1 inlcudes in its bottom rear zone a recess 2 of circular configuration which is complementary to an annular rotary portion 3 which is located in recess 2 and is rotatably mounted on a spigot 4 which is integrally formed with base portion 1 and projects into recess 2. Rotary portion 3 is slightly resilient to permit it to be removably engaged with spigot 4.

In order to retain rotary portion 3 against axial withdrawal from spigot 4 during use, spigot 4 has a concave peripheral configuration as indicated at 5 in FIG. 2 and rotary portion 3 has a bore 3a with a complementary convex internal configuration as indicated at 6 in FIG. 2. Base portion 1 may further include an annular groove 7 round the base of spigot 4 in which annular ridge 8 on rotary portion 3 is located. Spigot 4 may be slightly shorter in length than the thickness of rotary portion 3 as shown in FIG. 2, to avoid engagement of the outer end of spigot 4 with the ground.

In use, the rotary portion 3 of the heel presents a rear ground engaging zone of the heel. When the rotary portion 3 engages the ground, the base portion 1 of the heel and the shoe or boot to which the base portion 1 is attached, is capable of rotating relative to the rotary portion 3 without the latter rotating relative to the ground, thereby to avoid or at least to minimize frictional wear on the rotary portion 3. Also, as rotation of the rotary portion 3 relative to the base portion 1 occurs, different peripheral zones of the lower face of the rotary portion 3 constitute the ground engaging rear edge of the heel, thereby to distribute impact wear round the entire periphery of the rotary portion 3 and extend the life of the rotary portion.

Since rotary portion 3 is removably mountable on spigot 4, the rotary portion 3 may be replaced quickly and easily when it becomes worn.

Figure 4:
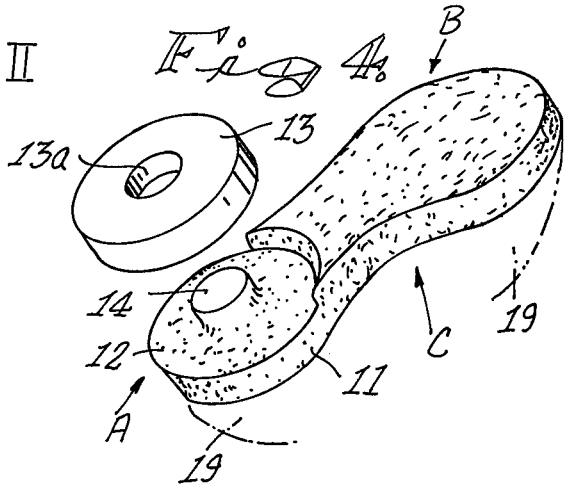
FIG. 4 is a bottom perspective view of a sole and heel unit including a heel according to the invention.

With the arrangement of FIGS. 1 to 3, the base portion 1 of heel A is attachable to the remainder of a shoe or boot. In the arrangement of FIG. 4, the base portion 11 of heel A is integrally formed with a sole B to provide a heel and sole unit C which may be attached to the upper portion 19 of a shoe or boot in any suitable manner depending on the material of the parts to be attached. Thus, where the integral sole and heel unit C is made of rubber or other suitable polymer material, the unit C may be attached to the upper portion 19 by means of adhesive and/or heat fusion.

Base portion 11 of heel A includes a recess 12 and a mounting spigot 14 extending into recess 12. Annular rotary portion 13 of heel A is of circular configuration and is locatable in complementary recess 12 in base portion 11. Rotary heel portion 13 is rotatably mountable in removable manner on spigot 14 with the latter located in bore 13a in rotary portion 13.

It will be appreciated that many variations in detail are possible without departing from the scope of the appended claims. For example, instead of base portion 1 or 11 of heel A presenting a spigot 4 or 14 respectively adapted rotatably to mount an annular rotary portion 3 or 13 respectively as described above, a mounting socket adapted rotatably to receive a complementary mounting spigot extending from rotary portion 3 or 13 respectively, may be provided in the bottom of the recess 2 or 12 respectively in base portion 1 or 11 respectively of heel A.

Furthermore, any suitable tread, design or the like may be provided on the bottom ground engaging face of rotary portion 3 or 13 and/or of base portion 1 or 11 of heel A and/or of sole B to minimize the danger of slipping.

Also, an entire heel may be rotatably mounted on a shoe or boot.

The invention includes within its scope not only an article of footwear including a rotary heel or heel portion as defined above, but also a footwear heel as such in which at least a portion of the heel which presents a rear ground engaging zone of the heel is adapted to be rotatable relative to an article of footwear on which the heel is mounted.

Preferably, the heel comprises a base portion adapted to be attached to the remainder of the article of footwear; and a rotary portion rotatably mountable on the base portion and presenting a rear ground engaging edge of the heel.

The base portion may be integrally formed with a sole for the article of footwear.

I claim:

1. An article of footwear including a heel, at least a portion of the heel which presents a rear ground engaging zone of the heel being annular, another portion of the heel comprising a spigot having an annular concave side surface, said annular portion of the heel having an annular convex inner surface complementary to said annular concave side surface of said spigot, said annular portion being rotatable on and relative to said spigot when said footwear is in use and said annular portion is pressed against the ground, said annular portion having an annular ridge about its inner periphery that extends upwardly above the level of the remainder of said annular portion and that fits in a complementary downwardly opening groove that surrounds the base of said spigot, said spigot being slightly shorter in length that the thickness of said annular portion to avoid engagement of the lower end of the spigot with the ground.

* * * * *